US005542994A

United States Patent [19]

Seto et al.

[11] Patent Number: 5,542,994

[45] Date of Patent: Aug. 6, 1996

[54] METHOD FOR MANUFACTURING A HIGH-FORMABLE, HIGH-STRENGTH COLD-ROLLED STEEL SHEET EXCELLENT IN RESISTANCE TO SECONDARY WORKING EMBRITTLEMENT

[75] Inventors: Kazuhiro Seto; Kaneharu Okuda; Kei Sakata; Toshiyuki Kato; Takashi Ono, all of Chiba, Japan

[73] Assignee: Kawasaki Steel Corporation, Japan

[21] Appl. No.: 363,365

[22] Filed: Dec. 23, 1994

[30] Foreign Application Priority Data

Dec. 24, 1993 [JP] Japan ..... 5-328666

[51] Int. Cl.[6] ..... C21D 8/02

[52] U.S. Cl. ..... 148/603; 148/651

[58] Field of Search ..... 148/603, 651, 148/320

[56] References Cited

U.S. PATENT DOCUMENTS 4,965,025 9/1990 Koyama et al. .

FOREIGN PATENT DOCUMENTS 0510718 10/1992 European Pat. Off. .
163318 6/1990 Japan ..... 148/603
405247540 9/1993 Japan ..... 148/603
405279748 10/1993 Japan ..... 148/603
6-010095 1/1994 Japan .

*Primary Examiner*—Deborah Yee
*Attorney, Agent, or Firm*—Austin R. Miller

[57] ABSTRACT

A method of producing a high-formable, high-strength cold-rolled steel sheet from a steel slab comprising a steel with very low carbon content, one or both of Ti and Nb as a composition for forming a carbide or a nitride, and B in the range satisfying the following expression:

$$0.001\ A \leqq B\ (\text{wt}\ \%) \leqq 0.003\ A$$

wherein A is a parameter determined approximately by the following expression with reference to the relation:

A=P (wt %)+0.2 Mn (wt %)+0.8 Si (wt %)−0.2, subjecting the steel to a hot rolling so as to finish at a temperature between about $Ar_3$ transformation temperature and about $Ar_3$ transformation temperature +100 C°. Thereafter, the steel is successively subjected to coiling, cold-rolling and, then, continuous annealing at temperatures between $Ac_1$ transformation temperature +5 C° and $Ac_1$ transformation temperature +50 C°, and not lower than 860 C°. Thus, a volume percentage of a low temperature transformation phase is controlled within the range of about 5 to about 50%, thereby obtaining a high strength cold-rolled steel sheet having a tensile strength of 38 kgf/mm$^2$ or more, plus excellent formability and resistance to secondary working embrittlement.

2 Claims, 1 Drawing Sheet

FIGURE
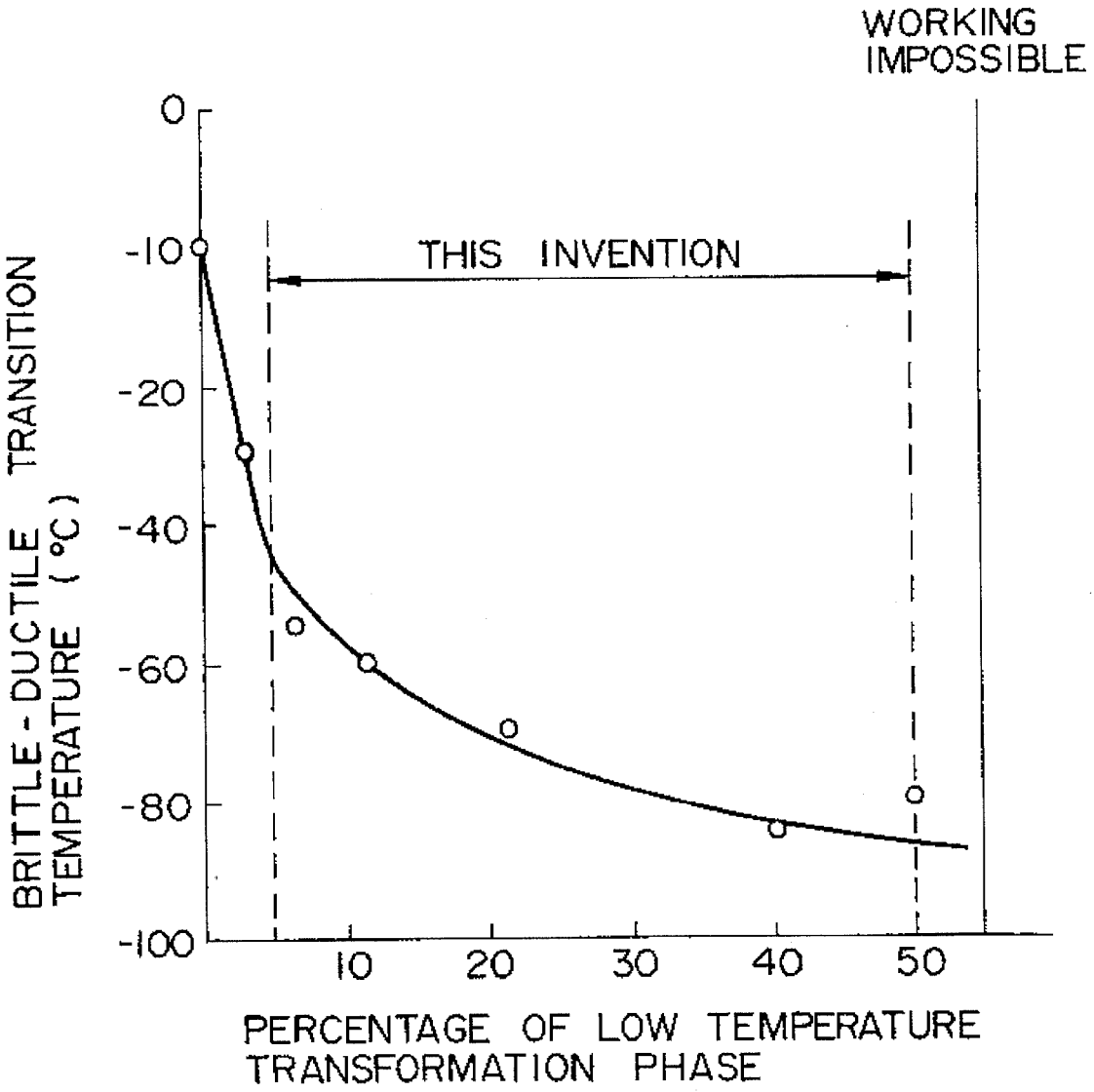

METHOD FOR MANUFACTURING A HIGH-FORMABLE, HIGH-STRENGTH COLD-ROLLED STEEL SHEET EXCELLENT IN RESISTANCE TO SECONDARY WORKING EMBRITTLEMENT

BACKGROUND OF THE INVENTION

1. Field of the Invention

The present invention relates to a method for manufacturing a high formable, high strength cold-rolled steel sheet excellent in resistance to secondary working embrittlement.

2. Description of the Related Art

The prior art concerning high-strength cold-rolled steel sheet is extensive. High-strength cold-rolled steel sheet consists of a base steel which is fully decarburized during manufacturing, producing a very low carbon content. To secure formability, C and N dissolved in the base steel are fixed as carbides or nitrides by Ti, Nb, or other fixing elements contained therein. The base steel also comprises dissolved strengthening compositions of Si, P, Mn, etc. to improve strength.

For example, Japanese Laid-Open Patent Publication No. 63-190141 discloses a cold-rolled steel sheet in which Mn and P are added to Ti-containing steel with very low carbon content as described above. In such a cold-rolled steel sheet, adding suitable amounts of Mn and P causes a small amount of dissolved carbon to remain after annealing of the steel sheet, thereby significantly increasing the r-value of the sheet, i.e. Rankford value which is a measure of formability. Additionally, secondary working embrittlement is avoided due to the dissolved carbon remaining at a grain boundary. However, when large amounts of P are added to the above-described steel to produce greater steel strength, resistance to secondary working embrittlement is significantly deteriorated.

The addition of B is well known for improving the resistance of steel to secondary working embrittlement. However, steel sheet to which large amounts of solid-solution strengthening compositions are added tends to become embrittled by those same solid-solution strengthening compositions. Therefore, large amounts of B are required to ensure efficient resistance to secondary working embrittlement. When excessive amounts of B are added, however, formability and hot rolling properties of the steel tend to deteriorate.

In Japanese Patent Publication No. 59-42742, there is proposed a steel to which Si is added as a solid-solution strengthening composition in addition to Mn and P, and B is added to improve resistance to secondary working embrittlement so as to produce a high strength steel with a high r-value. The yield ratio of this cold rolled steel sheet is a very low 60% or less. However, we discovered that when the tensile strength of this high strength cold-rolled steel sheet exceeds 40 kgf/mm$^2$, containing solid-solution elements such as Si, Mn and P and having a ferrite single phase structure, it is almost impossible to obtain highly formable steel.

The steels described in Japanese Laid-Open Patent Publication No. 63-190141 and Japanese Patent Publication No. 59-42742 can be obtained by subjecting to annealing at a temperature below the $Ac_1$ transformation temperature to get ferrite single phase structure. Another publications recite methods of increasing steel strength which involve annealing the steel in two phase regions to produce a hard second phase. However, the second phase is merely used for securing the strength of the steel, and there is no consideration regarding formability and resistance to secondary working embrittlement.

A cold-rolled steel sheet possessing a well-balanced array of properties, including high tensile strength of 38 kgf/mm$^2$ or more, formability and resistance to secondary working embrittlement would be desirable for many applications, including outer panel applications in automobiles and household appliances.

SUMMARY OF THE INVENTION

It is an object of the present invention to provide a method of manufacturing a high r-value and high-strength cold-rolled steel sheet having a tensile strength of 38 kgf/mm$^2$ or more, excellent formability and secondary working embrittlement using a steel of very low carbon content to which Ti, Nb and B are added in combination as a base steel.

To achieve the object described above, the present inventors have extensively studied steel with very low carbon content to which Ti, Nb and B are added in combination. The studies revealed that when Si, P, Mn, Ti, Nb and B are added to a steel of very low carbon content, there surprisingly exists a critical quantity range of B determined in accordance with the amounts of the above-described elements which when added produces effective resistance to secondary working embrittlement. It has been further discovered that the quantity of B required to produce resistance to secondary working embrittlement can be decreased significantly by annealing the steel in two phase regions to disperse the second phase in a parent phase.

It is known that by adding P to a steel sheet with very low carbon content, P is segregated at grain boundaries causing embrittlement at the grain boundaries. It has subsequently become known that Si and Mn have less effect on brittleness when they are added individually to steel having a very low carbon content, but the secondary working embrittlement of the steel further deteriorates when Si and Mn are added in combination to the P-added steel, for reasons that are not yet clear.

The addition of B effectively strengthens the grain boundaries against secondary working embrittlement. However, the addition of B tends toward the disadvantages that tensile properties, especially elongation and the r-value of the steel, are deteriorated, and recrystallization of austenite grains upon hot rolling is delayed. Therefore, adding excessive quantities of B is undesirable.

It is an object of this invention to develop a steel sheet having excellent resistance to secondary working embrittlement while minimizing the B content of the steel. It has now been discovered that resistance to secondary working embrittlement can be improved by conducting high temperature annealing and that this disperses the second phase in the ferrite phase. This effect may be the result of both the second phase retarding the progress of cracks in the steel sheet and the strengthening of grain boundaries by providing dissolved C generated by decomposition of TiC and NbC during high temperature annealing.

Based on the results described above, we have discovered that there is a critical quantity range of B to be added in accordance with the amounts of solid-solution strengthening compositions such as Si, P and Mn, and have succeeded in producing high-strength cold-rolled steel sheets possessing high formability and excellent resistance to secondary working embrittlement.

That is to say, in one form of the present invention, there is provided a method of manufacturing a high-strength cold-rolled steel sheet with high formability and excellent resistance to secondary working embrittlement from a steel slab containing:

about 0.0005 to about 0.005 wt % of C;

about 0.2 to about 1.5 wt % of Si;

about 0.5 to about 2.5 wt % of Mn;

about 0.05 to about 0.15 wt % of P;

about 0.02 wt % or less of S;

about 0.1 wt % or less of sol.Al;

about 0.005 wt % or less of N;

one or both of about 0.005 to about 0.2 wt % of Ti and about 0.005 to about 0.2 wt % of Nb;

B in the amount within the approximate range of $$0.001\ A \leqq B\ (\text{wt }\%) \leqq 0.003\ A$$

wherein A is a parameter determined approximately by the following expression with reference to the relation $$A = P\ (\text{wt }\%) + 0.2\ Mn\ (\text{wt }\%) + 0.8\ Si\ (\text{wt }\%) - 0.2$$

and the balance Fe with incidental impurities;

the steps which comprise:

hot rolling to be finished at temperatures between about $Ar_3$ transformation temperature and about $Ar_3$ transformation temperature +100 C°;

coiling of the hot rolled steel sheet;

cold rolling of the coiled steel sheet;

continuous annealing at temperatures between about $Ac_1$ transformation temperature +5 C° and about $Ac_1$ transformation temperature +50 C°, and no lower than about 860 C°; and controlling volume percentage of a low temperature transformation phase of the steel within the range of about 5 to about 50%.

In another form of the present invention, there is provided a method of manufacturing a high-strength cold-rolled steel sheet with high formability and excellent resistance to secondary working embrittlement from a steel slab containing:

about 0.0005 to about 0.005 wt % of C;

about 0.2 to about 1.5 wt % of Si;

about 0.5 to about 2.5 wt % of Mn;

about 0.05 to about 0.15 wt % of P;

about 0.02 wt % or less of S;

about 0.1 wt % or less of sol.Al;

about 0.005 wt % or less of N;

one or both of about 0.005 to about 0.2 wt % of Ti and about 0.005 to about 0.2 wt % of Nb;

one or both of about 1.0 wt % or less of Cu and about 1.0 wt % or less of Ni;

B in the amount within the approximate range of:

$$0.001\ A \leqq B\ (\text{wt }\%) \leqq 0.003\ A$$

wherein A is a parameter determined approximately by the following expression with reference to the relation:

$$A = P\ (\text{wt }\%) + 0.2\ Mn\ (\text{wt }\%) + 0.8\ Si\ (\text{wt }\%) + 0.1\ (Cu + Ni\ (\text{wt }\%)) - 0.2$$

and the balance Fe with incidental impurities;

the steps which comprise:

hot rolling to be finished at temperatures between about $Ar_3$ transformation temperature and about $Ar_3$ transformation temperature +100 C°;

coiling of the hot rolled steel sheet;

cold rolling of the coiled steel sheet;

continuous annealing at temperatures between about $Ac_1$ transformation temperature +5 C° and about $Ac_1$ transformation temperature +50 C° , and no lower than about 860 C°; and controlling volume percentage of a low temperature transformation phase of the steel within the range of about 5 to about 50%.

A cold-rolled steel sheet according to the present invention is used, for example, as an outer panel for automobiles and household electrical appliances (after undergoing appropriate surface treatment and a press forming). The formability and strength required in such applications is remarkably achieved by the present invention so that a significant weight reduction in the associated products is achieved.

BRIEF DESCRIPTION OF THE DRAWING

FIG. 1 is a graph showing the effect of volume percentage of the low temperature transformation phase on the brittle-ductile transition temperature of the product.

DETAILED DESCRIPTION OF THE INVENTION

In the present invention, the steel composition and manufacturing conditions for the steel are preferably within the following ranges:

C: about 0.0005 to about 0.005 wt %

When dissolved C remains in large amounts upon recrystallization, the r-value of the steel is significantly deteriorated. Further, large amounts of dissolved C require accordingly large additions of Ti and Nb for fixing the dissolved C. Therefore, it is preferred that the content of Ti and Nb is about 0.005 wt % or less, more preferably about 0.004 wt % or less, most preferably about 0.003 wt % or less. Present technology dictates that the minimum lower limit for C content is about 0.0005 wt %.

Si: about 0.2 to about 1.5 wt %

Si functions well in solid-solution strengthening compositions because it possesses effective solid-solution strengthening ability yet does not deteriorate r-value significantly. Therefore, at least about 0.2 wt % of Si should be added to obtain the desired strength. However, since surface treatment properties deteriorate as the content of Si increases, the upper limit of Si is about 1.5 wt %.

Mn: about 0.5 to about 2.5 wt %

Mn serves an important function in the present invention because Mn, unlike Si or P, lowers transformation temperature. Thus, by using Mn effectively, grains of the hot-rolled steel sheet can be reduced to a fine size. Since the fine-graining of the hot-rolled steel sheet causes favorable texture development of the annealed sheet, it is very effective to use Mn for improving the r-value of the steel. Therefore, a lower limit of about 0.5 wt % of Mn should preferably be added. Furthermore, in view of the retarding effect Mn has on secondary working embrittlement induced by the presence of P, it is desired that the content of Mn is preferably set to about 1.0 wt % or more. On the other hand, since Mn itself deteriorates the r-value, excessive additions of Mn are undesirable. When the content of Mn exceeds about 2.5 wt %, a low temperature transformation phase is easily produced, the ferrite phase disappears and the r-value is seriously deteriorated. Therefore, the upper limit of the content of Mn is preferably about 2.5 wt %.

Further, the amount of Mn added relative to quantities of Si and P added should satisfy the following expression:

$$0.2 \leqq (Si\ (wt\ \%)+P\ (wt\ \%))/Mn\ (wt\ \%) \leqq 1.0$$

When the relationship (Si(wt %)+P(wt %))/Mn(wt %) becomes 0.2 or less, the r-value of the steel is deteriorated. Conversely, when that relationship becomes 1.0 or more, the transformation temperature increases and fine-graining of the hot-rolled sheet can not be attained.

P: about 0.05 to about 0.15 wt %

P is an important component in a solid-solution strengthening composition because P has a higher solid-solution strengthening ability than Si and Mn, and is effective for improving the r-value. Thus, a minimum of about 0.05 wt % P should preferably be added. On the other hand, P, when added in large quantities, segregates at a grain boundary to embrittle the grain boundary and causes a center segregation upon solidification thereof. Therefore, it is preferred that the content of P remain about 0.15 wt % or less, more preferably 0.12 wt % or less, and most preferably 0.10 wt % or less.

S: about 0.02 wt % or less

S has no effect on the r-value of the steel. However, when the content of S increases, inclusions such as MnS increase, thereby causing reduction of a local ductility, typified by stretch-flanging property. Therefore, it is preferable to limit the content of S to about 0.02 wt % or less.

sol. Ai: about 0.1 wt % or less

Sol. A1 enables a deoxidation effect which is maximized at about 0.1 wt %. Exceeding about 0.1 wt % of sol. Al not only fails to enhance the deoxidation effect but also generates inclusions, thereby exerting an adverse effect on formability of the steel. Therefore, the content of sol. A1 is preferably about 0.1 wt % or less.

N: about 0.005 wt % or less

N is an impurity which is inevitably mixed into the steel. When Ti is added to the steel, N is fixed to the steel as TiN to improve formability. However, the presence of TiN in large amounts also deteriorates formability of the steel. Therefore, the upper limit of the content of N is preferably about 0.005 wt %.

Ti: about 0.005 to about 0.2 wt %

Ti is effective in fixing dissolved C, N and S as TiC, TiN and TiS to the steel. When the amount of Ti is less than about 0.005 wt %, dissolved C, N and S can not be sufficiently fixed to the steel. On the other hand, when the amount of Ti exceeds about 0.2 wt %, phosphides are generated which deteriorate elongation and the r-value.

Nb: about 0.005 to about 0.2 wt %

Nb, like Ti, is used for fixing dissolved C (as NbC) to the steel. Dissolved C can be fixed to the steel with only Ti, but can be more effectively fixed with further addition of Nb. However, excessive amounts of Nb causes non-recrystallization of austenite upon hot rolling, and formability of the annealed steel is adversely affected. Therefore, the amount of Nb to be added is preferably about 0.005 to about 0.2 wt %.

B: preferable amounts determined according to amounts of P, Mn and Si, etc. present.

B is added to the steel to prevent secondary working embrittlement. Particularly, according to the present invention, since a solid-solution strengthening composition is added to a steel of very low carbon content, secondary working embrittlement of the steel increases. Thus, it is preferred that B be added to the steel in amounts dictated by the secondary working embrittlement caused by addition of solid-solution strengthening compositions such as Si, Mn and P. Excessive addition of B delays the recrystallization of austenite upon hot rolling, increases the load upon rolling and deteriorates quality of the annealed steel. Therefore, it is preferable that the content of B be about 0.0002 to about 0.005 wt %. Further, B is preferably added to the steel in the amount within the approximate range of:

$$0.001\ A \leqq B\ (wt\ \%) \leqq 0.003\ A$$

in which A is a parameter determined approximately by the following expression with reference to the relation:

$$A=P\ (wt\ \%)+0.2\ Mn\ (wt\ \%)+0.8\ Si\ (wt\ \%)-0.2$$

or, determined approximately by the following expression with reference to the relation:

$$A+P\ (wt\ \%)+0.2\ Mn\ (wt\ \%)+0.8\ Si\ (wt\ \%)+0.1\ (Cu+Ni\ (wt\ \%))-0.2$$

It is important to add a critical amount of B to the steel in accordance with the amounts of solid-solution strengthening compositions added to the steel. This is because the steel is embrittled not only by the addition of P but also by addition of Si, Mn, Cu and Ni. When the quantity of B is approximately less than the product of 0.001 and parameter A calculated by the above expressions, the steel embrittlement due to the solid-solution strengthening components is not effectively compensated by the quantity of B. On the other hand, when B additions approximately exceed the product of 0.003 and parameter A, the detrimental effect on the annealing material described above increases. Therefore, the amount of B to be added is preferably within the range of about 0.001 A to about 0.003 A. In the above expressions, each of factors Mn, Si, Cu and Ni generate a degree of embrittlement by wt %, and each effect is calibrated to embrittlement effect generated by P. The final term is a correction factor.

Cu: about 1.0 wt % or less

Cu is a solid-solution strengthening component and is added to the steel according to the steel strength desired. However, when the amount of Cu exceeds about 1.0 wt %, Cu is deposited. Thus, the upper limit of the content of Cu is preferably about 1.0 wt %. It is preferable that Cu is added to the steel together with Ni so that the steel forms a low melting point phase.

Ni: about 1.0 wt % or less

Ni is one of the solid-solution strengthening components to be added to produce the steel strength desired. However, since the transformation temperature of the steel is significantly lowered by Ni, the upper limit of Ni to be added is preferably about 1.0 wt %.

In accordance with this invention, a steel slab having a composition as described above is used as a starting material and subjected to a hot rolling. This hot rolling must be finished at a temperature between about the $Ar_3$ transformation temperature and about the $Ar_3$ transformation temperature +100 C°. The hot-rolled steel is successively subjected to coiling, removal of surface scales, cold rolling and continuous annealing at temperatures between about the $Ac_1$ transformation temperature +5 C° and about the $Ac_1$ transformation temperature +50 C°, but no less than about 860 C° to set the volume percentage of the low temperature transformation phase within the range of about 5 to about 50%.

The finishing temperature FT (C°) of a hot rolling is controlled according to the following expression:

$$Ar_3\ \text{transformation temperature} \leqq FT\ (C°) \leqq Ar_3$$

transformation temperature +100 C°, and should be changed in accordance with $Ar_3$ transformation temperature of the steel. When the hot rolling finishing temperature is lower than the $Ar_3$ transformation temperature of the steel, rolling of the steel occurs in two phase regions and the resulting texture adversely effects the r-value of the annealed material. On the other hand, if the hot rolling finishing temperature is higher than about the $Ar_3$ transformation temperature +100 C°, the grain size of the hot-rolled steel sheet becomes coarse, thus formation of a texture upon annealing effective for deep drawing becomes difficult.

Continuous annealing is preferably conducted after cold rolling of the steel. It is necessary that the annealing temperature T (C°) substantially satisfies the following expressions:

$$Ac_1 \text{ transformation temperature}+5\ C^\circ \leqq T \leqq Ac_1$$

transformation temperature +50 C° and T≧860 C°. A hard low temperature transformation phase which retards the progress of cracks generated at a grain boundary of a parent phase should be produced by setting the annealing temperature to the $Ac_1$ transformation temperature or above. Thus, in order to produce the low temperature transformation phase in a stable manner from a manufacturing viewpoint, the annealing temperature is preferably about $Ac_1$ transformation temperature +5 C° or above. However, when a high temperature annealing is conducted at a temperature exceeding about $Ac_1$ transformation temperature +50 C° or above, formability of the steel sheet is seriously deteriorated. In addition, the lower limit of the annealing temperature is set to 860 C° to ensure enough dissolved C for strengthening the grain boundary.

The volume percentage of the low temperature transformation phase, which is a hard second phase, is controlled within the range of about 5 to about 50% by conducting annealing at the temperature as described above. The lower limit of about 5% is a preferred value for retarding the progress of cracks at the grain boundary of the parent phase, and it is more preferably set to 8% or more, and most preferably set to 10% or more. The higher the percentage of the low temperature transformation phase, the more beneficial it is for the strength and embrittlement of the product steel. However, since formability of the product steel is deteriorated by the higher percentage, the percentage of the low temperature transformation phase is preferably about 50% or less, more preferably 40% or less, and most preferably 30% or less.

The following Examples are merely illustrative and are not intended to define or limit the scope of the invention, which is defined in the appended claims.

EXAMPLES

Various steels having the compositions (1–12) shown in Table 1 were manufactured by melting, and then subjected to hot rolling at various finishing temperatures shown in Table 2, followed by coiling and acid pickling. Then, the steels were cold-rolled with a rolling reduction of 80% and subjected to recrystallization annealing in a continuous annealing line at the annealing temperatures shown in Table 2. The thus obtained steel sheets were examined for tensile strength and secondary working embrittlement. The secondary working embrittlement was examined in the following manner: each of the steels was blanked out in 50 mm ϕ and drawn out with a punch of 24.4 mm ϕ to form earing-notched cups 21 mm high, then a weight of 5 kg was dropped from a height of 0.8 on the cups to have impact thereon, and the brittleness was subsequently evaluated by the presence of crack initiation.

TABLE 1

| | Composition (wt %) | | | | | | | | | | | | |
|---|---|---|---|---|---|---|---|---|---|---|---|---|---|
| Steel | C | Si | Mn | P | S | Al | N | Ti | Nb | B | Cu | Ni | Fe |
| 1 | 0.002 | 0.49 | 1.00 | 0.10 | 0.005 | 0.054 | 0.004 | 0.033 | 0.004 | 0.0015 | 0.01 | 0.01 | Balance |
| 2 | 0.003 | 0.50 | 1.51 | 0.10 | 0.005 | 0.055 | 0.003 | 0.035 | 0.003 | 0.0005 | 0.01 | 0.01 | " |
| 3 | 0.002 | 0.53 | 1.51 | 0.11 | 0.007 | 0.056 | 0.002 | 0.018 | 0.000 | 0.0015 | 0.01 | 0.00 | " |
| 4 | 0.003 | 0.49 | 2.20 | 0.10 | 0.005 | 0.053 | 0.004 | 0.010 | 0.020 | 0.0023 | 0.00 | 0.01 | " |
| 5 | 0.002 | 0.30 | 0.99 | 0.15 | 0.005 | 0.052 | 0.004 | 0.004 | 0.021 | 0.0012 | 0.01 | 0.01 | " |
| 6 | 0.002 | 1.20 | 1.70 | 0.05 | 0.003 | 0.028 | 0.004 | 0.040 | 0.006 | 0.0030 | 0.01 | 0.01 | " |
| 7 | 0.002 | 0.49 | 3.05 | 0.10 | 0.005 | 0.052 | 0.003 | 0.036 | 0.004 | 0.0006 | 0.01 | 0.00 | " |
| 8 | 0.001 | 0.71 | 1.25 | 0.05 | 0.006 | 0.032 | 0.002 | 0.006 | 0.005 | 0.0020 | 0.00 | 0.00 | " |
| 9 | 0.002 | 0.51 | 1.02 | 0.08 | 0.007 | 0.024 | 0.003 | 0.007 | 0.005 | 0.0012 | 0.00 | 0.61 | " |
| 10 | 0.002 | 0.51 | 1.02 | 0.08 | 0.004 | 0.044 | 0.003 | 0.005 | 0.034 | 0.0030 | 0.70 | 0.00 | " |
| 11 | 0.002 | 0.50 | 1.02 | 0.08 | 0.003 | 0.045 | 0.002 | 0.032 | 0.005 | 0.0012 | 0.71 | 0.40 | " |
| 12 | 0.002 | 0.49 | 1.00 | 0.08 | 0.003 | 0.040 | 0.002 | 0.035 | 0.005 | 0.0040 | 0.71 | 0.40 | " |

| Steel | (Si + P) /Mn | $Ac_1$ transformation temp. (°C.) | Parameter A (*1) | Parameter A × 0.001 | Parameter A × 0.003 | Note (*2) |
|---|---|---|---|---|---|---|
| 1 | 0.59 | 923 | 0.59 | 0.0006 | 0.0018 | B |
| 2 | 0.40 | 895 | 0.75 | 0.0008 | 0.0023 | C |
| 3 | 0.42 | 899 | 0.78 | 0.0008 | 0.0023 | B |
| 4 | 0.27 | 856 | 0.95 | 0.0010 | 0.0029 | B |
| 5 | 0.45 | 923 | 0.49 | 0.0005 | 0.0015 | B |
| 6 | 0.74 | 921 | 1.32 | 0.0013 | 0.0040 | B |
| 7 | 0.19 | 808 | 1.21 | 0.0012 | 060036 | C |
| 8 | 0.61 | 912 | 0.79 | 0.0008 | 0.0024 | B |
| 9 | 0.58 | 897 | 0.59 | 0.0006 | 0.0018 | B |
| 10 | 0.58 | 898 | 0.59 | 0.0006 | 0.0018 | B |
| 11 | 0.57 | 883 | 0.70 | 0.0007 | 0.0021 | B |
| 12 | 0.57 | 883 | 0.68 | 0.0007 | 0.0020 | C |

(*1) Parameter A = P(wt %) + 0.2 Mn(wt %) + 0.8 Si(wt %) + 0.1(Cu + Ni (wt %)) >–0.2
(*2) B means This Invention.
C means Comparative steel.

TABLE 2

| Steel | FDT (°C.) | Annealing temperature (*) (°C.) | Percentage of second phase (%) | T.S. (kgf/mm$^2$) | r - value | A.I. value (kgf/mm$^2$) | Brittle-Ductile transition temperature (°C.) | Evaluation of embrittlement | Note |
|---|---|---|---|---|---|---|---|---|---|
| 1 | 880 | 930 | 22 | 42.2 | 2.07 | 3.1 | −65 | o | This invention |
| 1 | 880 | 840 | 0 | 44.6 | 1.75 | 0.5 | −20 | x | Comparative steel |
| 2 | 870 | 900 | 18 | 46.5 | 2.11 | 2.7 | −10 | x | Comparative steel |
| 3 | 860 | 910 | 10 | 45.2 | 2.02 | 2.8 | −50 | o | This invention |
| 4 | 860 | 865 | 13 | 47.9 | 1.8 | 1.9 | −50 | o | This invention |
| 4 | 860 | 900 | 71 | 52.4 | 1.5 | 2.3 | working impossible | x | Comparative steel |
| 5 | 900 | 930 | 26 | 42.3 | 1.92 | 3.2 | −60 | o | This invention |
| 6 | 870 | 930 | 12 | 49.5 | 2.01 | 3.2 | −50 | o | This invention |
| 7 | 900 | 800 | 0 | 50.3 | 0.52 | 0.6 | 30 | x | Comparative steel |
| 8 | 870 | 920 | 20 | 46.2 | 2.12 | 3.7 | −50 | o | This invention |
| 9 | 880 | 910 | 21 | 44.2 | 2.01 | 3.1 | −60 | o | This invention |
| 10 | 880 | 910 | 24 | 43.9 | 2.12 | 3.6 | −70 | o | This invention |
| 11 | 900 | 890 | 9 | 46.3 | 1.81 | 3.4 | −60 | o | This invention |
| 12 | 900 | 890 | 11 | 47.0 | 1.68 | 3.5 | −70 | o | This invention |

(*) Annealing time: 40 second

In Table 2, strength properties and results of the test for secondary working embrittlement of the product steels according to each of the manufacturing conditions are summarized. As is apparent from Table 2, the product steel according to the present invention satisfied the relationship represented by the following expression:

$$0.001\ A \leqq B\ (\text{wt }\%) \leqq 0.003\ A$$

wherein A is a parameter calculated using one of the following expressions:

$$A = P\ (\text{wt }\%) + 0.2\ Mn\ (\text{wt }\%) + 0.8\ Si\ (\text{wt }\%) - 0.2$$

or $$A = P\ (\text{wt }\%) + 0.2\ Mn\ (\text{wt }\%) + 0.8\ Si\ (\text{wt }\%) + 0.1\ (Cu + Ni\ (\text{wt }\%)) - 0.2,$$

and the second phase was produced by annealing at the temperatures of $Ac_1$ transformation temperature or above, exhibits a high r-value and excellent resistance to secondary working embrittlement.

FIG. 1 shows the relationship between the brittle-ductile transition temperature and the percentage of low temperature transformation phase when the percentage of the low temperature transformation phase was varied by changing the annealing condition with respect to a steel 2 in Table 1. It is apparent from FIG. 1 that a steel with excellent resistance to secondary working embrittlement was obtained by controlling the volume percentage of the second phase. However, when the volume percentage of the second phase exceeded about 50%, the formability of the steel rapidly deteriorated.

According to the present invention, a high strength cold-rolled steel sheet having a tensile strength of 38 kgf/mm$^2$ or more, plus excellent formability and resistance to secondary working embrittlement is obtained, thereby attaining highly beneficial weight reduction for use in, for example, outer panel applications in automobiles and household electrical appliances.

Although the invention has been described with reference to specific material compositions and method steps, equivalent steps may be substituted, the sequence of steps of the method may be varied, and certain steps may be used independently of others. Further, various other control steps may be included, all without departing from the spirit and scope of the invention, which is defined in the appended claims.

What is claimed is:

1. In a method of producing a highly-formable, high-strength cold-rolled steel sheet from a steel slab having the composition:

about 0.0005 to about 0.005 wt % of C;

about 0.2 to about 1.5 wt % of Si;

about 0.5 to about 2.5 wt % of Mn;

about 0.05 to about 0.15 wt % of P;

about 0.02 wt % or less of S;

about 0.1 wt % or less of sol.Al;

about 0.005 wt % or less of N;

one or both of about 0.005 to about 0.2 wt % of Ti and about 0.005 to about 0.2 wt % of Nb;

B in the amount within the approximate range of:

$$0.001\ A \leqq B\ (\text{wt }\%) \leqq 0.003\ A$$

wherein A is a parameter determined approximately by the following expression with reference to the relation:

$$A = P\ (\text{wt }\%) + 0.2\ Mn\ (\text{wt }\%) + 0.8\ Si\ (\text{wt }\%) - 0.2;$$

and the balance Fe with incidental impurities;

the steps which comprise:

hot rolling said steel slab into a steel sheet to be finished at a temperature of between about $Ar_3$ transformation temperature and about $Ar_3$ transformation temperature 100 C°;

coiling of said steel sheet;

cold rolling of said steel sheet;

continuous annealing of said steel sheet at a temperature between about $Ac_1$ transformation temperature +5 C° and about $Ac_1$ transformation temperature +50 C°, and not lower than about 860 C°; and controlling low temperature transformation phase in said steel sheet within the volume percentage range of about 5 to about 50% to strengthen and reduce secondary working embrittlement in said steel sheet.

2. In a method of producing a highly-formable, high-strength cold-rolled steel sheet from a steel slab having the composition:

about 0.0005 to about 0.005 wt % of C;

about 0.2 to about 1.5 wt % of Si;

about 0.5 to about 2.5 wt % of Mn;

about 0.05 to about 0.15 wt % of P;

about 0.02 wt % or less of S;

about 0.1 wt % or less of sol. Al;

about 0.005 wt % or less of N;

one or both of about 0.005 to about 0.2 wt % of Ti and about 0.005 to about 0.2 wt % of Nb;

one or both of about 1.0 wt % or less of Cu and about 1.0 wt % or less of Ni;

B in the amount within the approximate range of:

$$0.001\ A \leqq B\ (\text{wt}\ \%) \leqq 0.003\ A$$

wherein A is a parameter determined approximately by the following expression with reference to the relation:

$$A = P\ (\text{wt}\ \%) + 0.2\ Mn\ (\text{wt}\ \%) + 0.8\ Si\ (\text{wt}\ \%) + 0.1\ (Cu + Ni\ (\text{wt}\ \%)) - 0.2$$

and the balance Fe with incidental impurities;

the steps which comprise:

hot rolling said steel slab into a steel sheet to be finished at a temperature of between about $Ar_3$ transformation temperature and about $Ar_3$ transformation temperature +100 C°;

coiling of said steel sheet;

cold rolling of said steel sheet;

continuous annealing of said steel sheet at a temperature between about $Ac_1$ transformation temperature +5 C° and about $Ac_1$ transformation temperature +50 C°, and not lower than about 860 C°; and controlling low temperature transformation phase in said steel sheet within the volume percentage range of about 5 to about 50% to strengthen and reduce secondary working embrittlement in said steel sheet.

* * * * *

UNITED STATES PATENT AND TRADEMARK OFFICE

CERTIFICATE OF CORRECTION

PATENT NO. : 5,542,994

DATED : August 6, 1996

INVENTOR(S) : Kazuhiro Seto et al

It is certified that error appears in the above-indentified patent and that said Letters Patent is hereby corrected as shown below:

On title page, under "References Cited" to the right of "Koyama et al" insert --148/603--.

Column 5, line 23, please change "sol.Ai:" to --sol.Al--.

Column 8, Table 1, under subheading "Parameter Ax0.003", line 7, please change "060036" to --0.0036--.

Column 10, line 50, please change "100C$^{o}$" to --+100C$^{o}$--.

Signed and Sealed this

Twenty-ninth Day of October 1996

*Attest:*

Bruce Lehman

BRUCE LEHMAN

*Attesting Officer*

*Commissioner of Patents and Trademarks*